US010861634B2

(12) United States Patent
Miyamoto et al.

(10) Patent No.: US 10,861,634 B2
(45) Date of Patent: Dec. 8, 2020

(54) STATIONARY INDUCTION ELECTRIC DEVICE

(71) Applicant: Hitachi, Ltd., Tokyo (JP)

(72) Inventors: Naoya Miyamoto, Tokyo (JP); Yu Yamada, Tokyo (JP); Takashi Ishigami, Tokyo (JP); Naoyuki Kurita, Tokyo (JP); Akira Nishimizu, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 253 days.

(21) Appl. No.: 16/096,957

(22) PCT Filed: Apr. 27, 2016

(86) PCT No.: PCT/JP2016/063249
§ 371 (c)(1),
(2) Date: Oct. 26, 2018

(87) PCT Pub. No.: WO2017/187568
PCT Pub. Date: Nov. 2, 2017

(65) Prior Publication Data

US 2019/0122805 A1 Apr. 25, 2019

(51) Int. Cl.
*H01F 27/24* (2006.01)
*H01F 27/25* (2006.01)
(Continued)

(52) U.S. Cl.
CPC ..... *H01F 27/25* (2013.01); *H01F 27/06* (2013.01); *H01F 27/24* (2013.01); *H01F 27/263* (2013.01);
(Continued)

(58) Field of Classification Search
CPC ..... H01F 27/25; H01F 27/24; H01F 30/10; H01F 41/0226; H01F 27/263; H01F 27/266; H01F 27/06; H01F 17/06
See application file for complete search history.

(56) References Cited

U.S. PATENT DOCUMENTS 2,400,994 A * 5/1946 Horstman ..... H01F 27/25 336/210
2,488,391 A * 11/1949 Ford ..... H01F 27/25 336/210
(Continued)

FOREIGN PATENT DOCUMENTS

JP 4-17311 A 1/1992
JP 2013-243401 A 12/2013

OTHER PUBLICATIONS

International Search Report (PCT/ISA/210) issued in PCT Application No. PCT/JP2016/063249 dated Jun. 21, 2016 with English translation (three (3) pages).
(Continued)

*Primary Examiner* — Tuyen T Nguyen
(74) *Attorney, Agent, or Firm* — Crowell & Moring LLP

(57) ABSTRACT

The invention is directed to a stationary induction electric device that can reduce loss. To this end, the stationary induction electric device is provided with a first iron core block erected and formed in an annular shape, a second iron core block configured to surround the outer periphery of the first iron core block, a winding wound around the first and the second iron core blocks, a first support plate supporting the upper portion of the first iron core block from below, and a second support plate supporting the upper portion of the second iron core block from below, and a curvature radius of a curved portion appearing on the outer periphery of the lower portion of the second iron core block is made larger
(Continued)

than a curvature radius of a curved portion appearing on the outer periphery of the upper portion of the second iron core block.

8 Claims, 6 Drawing Sheets

(51) Int. Cl.

| | |
|---|---|
| ***H01F 30/10*** | (2006.01) |
| ***H01F 41/02*** | (2006.01) |
| ***H01F 27/26*** | (2006.01) |
| ***H01F 27/06*** | (2006.01) |
| *H01F 17/06* | (2006.01) |

(52) U.S. Cl.
CPC ..... *H01F 27/266* (2013.01); *H01F 30/10* (2013.01); *H01F 41/0226* (2013.01); *H01F 17/06* (2013.01)

(56) References Cited

U.S. PATENT DOCUMENTS

| | | | | |
|---|---|---|---|---|
| 2012/0161915 | A1* | 6/2012 | Mikoshiba ..... | H01F 27/25<br>336/210 |
| 2017/0345554 | A1* | 11/2017 | Waeckerle ..... | H01F 27/26 |

OTHER PUBLICATIONS

Japanese-language Written Opinion (PCT/ISA/237) issued in PCT Application No. PCT/JP2016/063249 dated Jun. 21, 2016 (three (3) pages).

* cited by examiner

[Fig. 1]
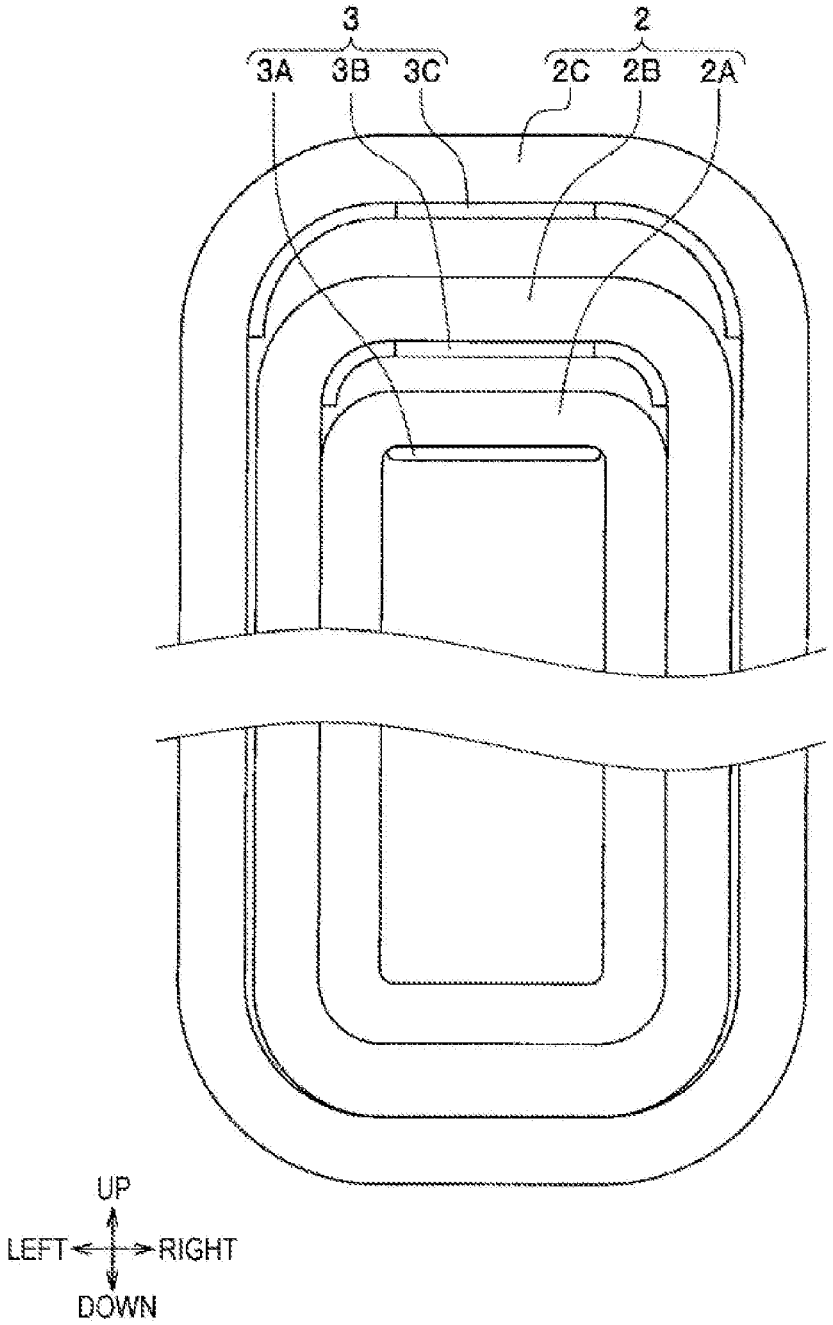

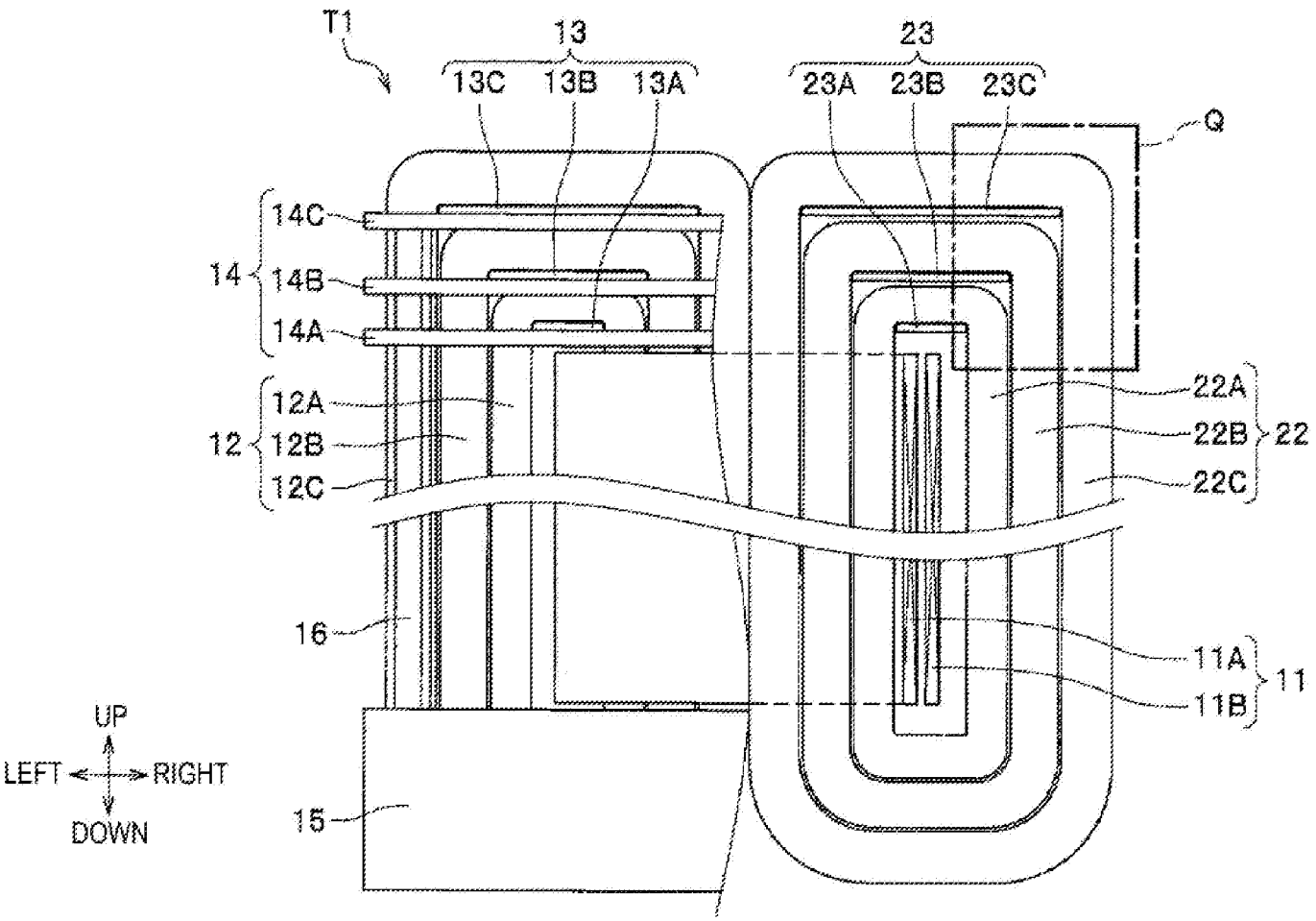
[Fig. 2]

[Fig. 3]
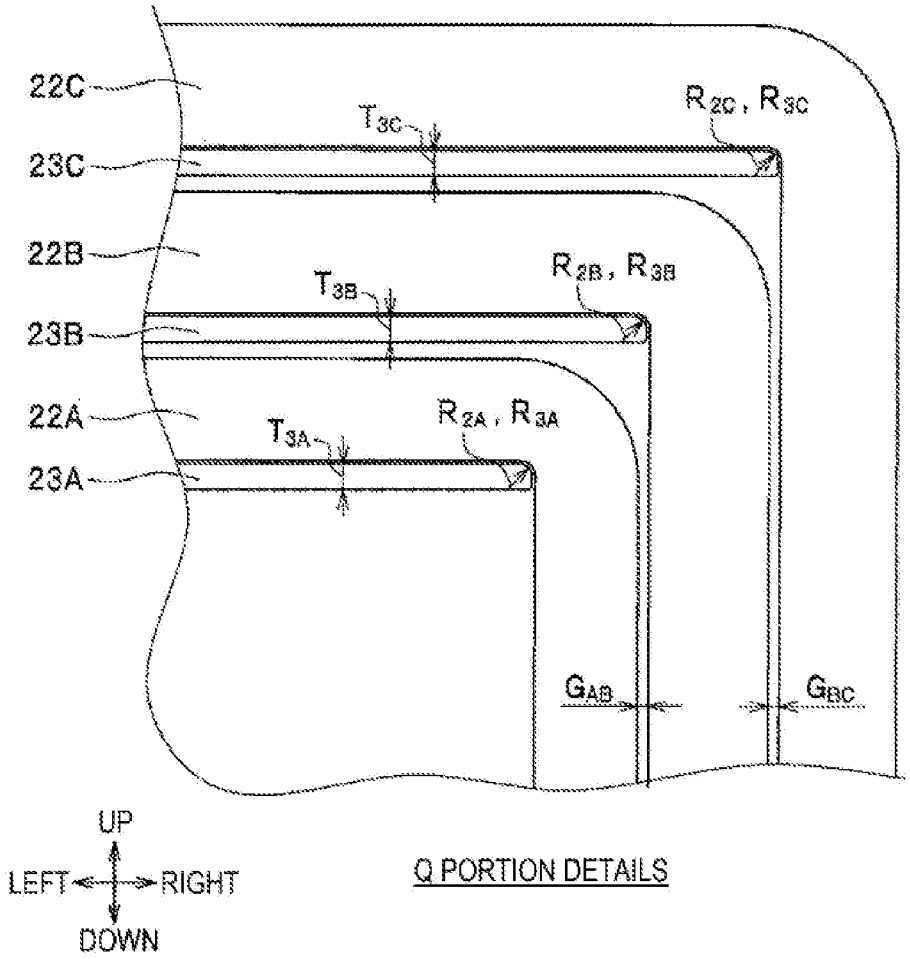
Q PORTION DETAILS

[Fig. 4]
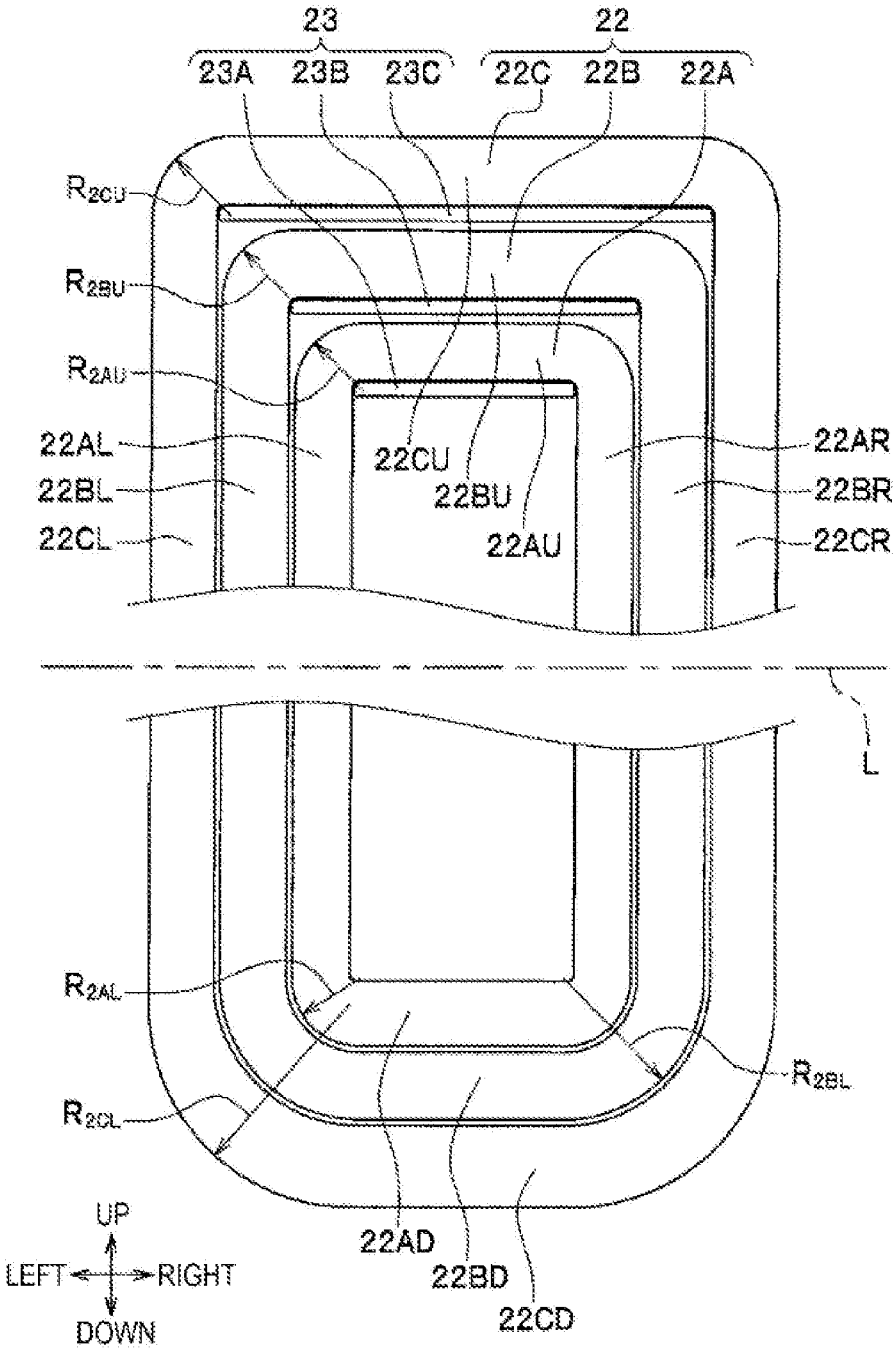

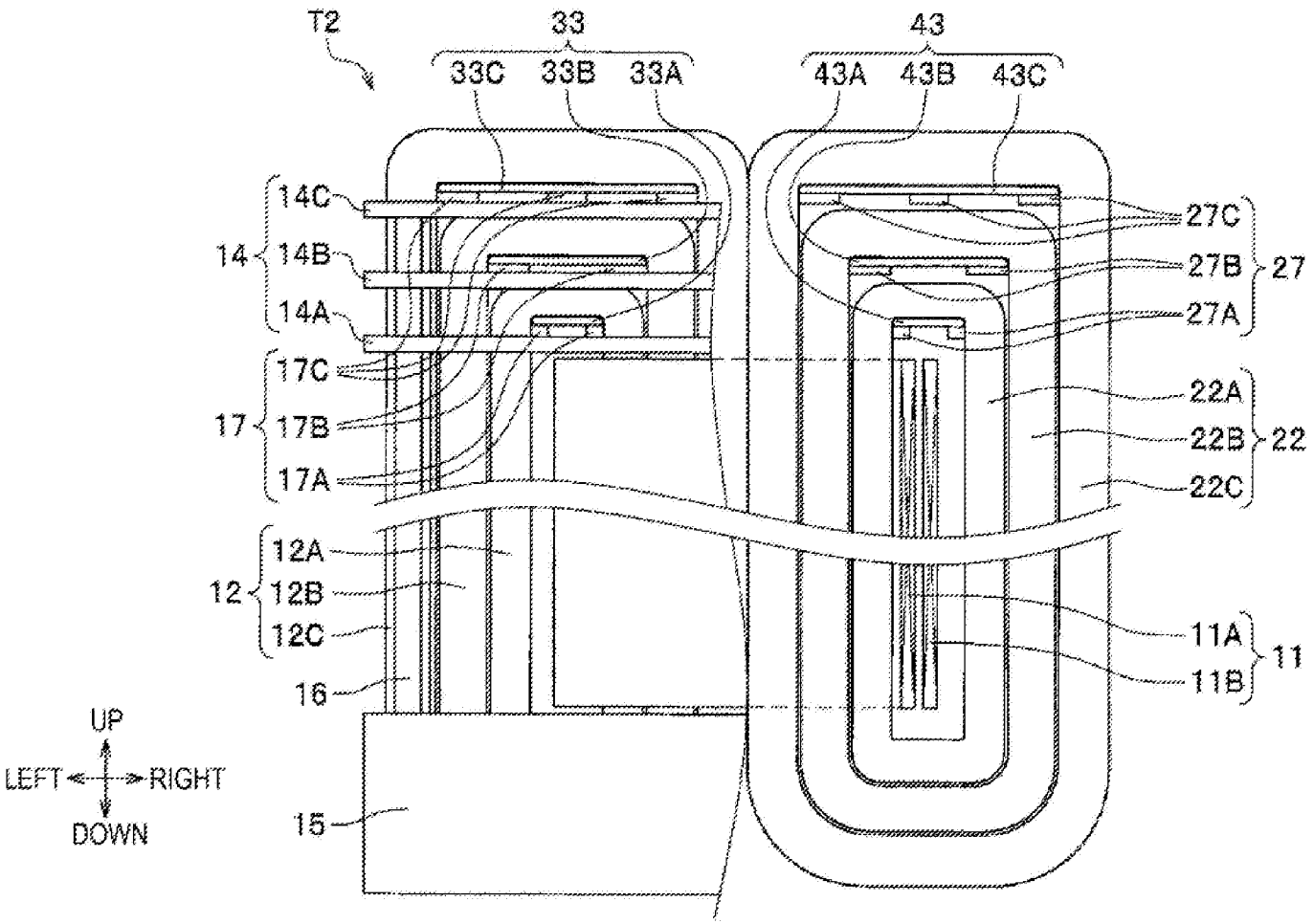
[Fig. 5]

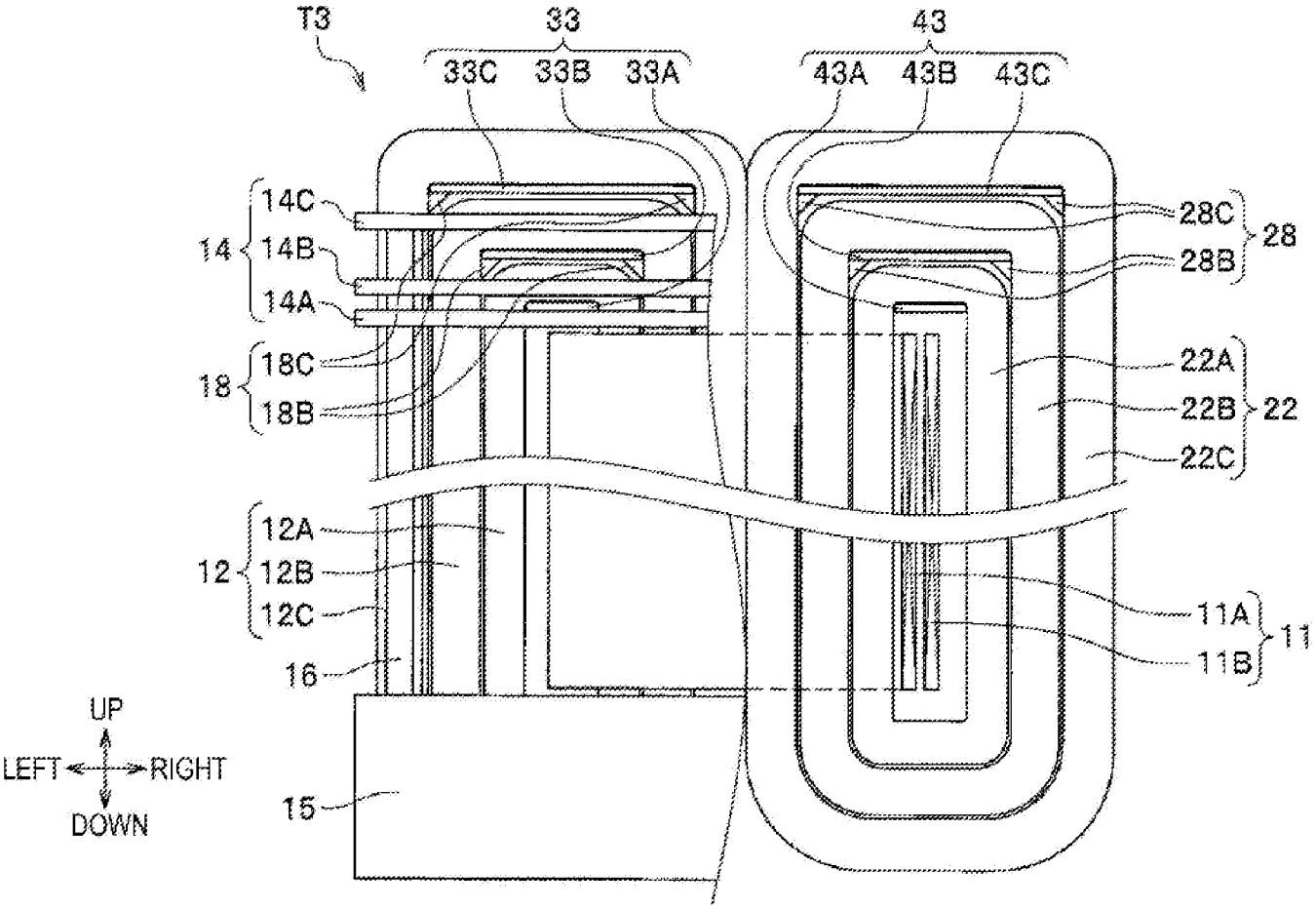
[Fig. 6]

STATIONARY INDUCTION ELECTRIC DEVICE

TECHNICAL FIELD

The present invention relates to a stationary induction electric device.

BACKGROUND ART

A stationary induction electric device such as a transformer and a reactor has an iron core composed with a magnetic body. A wound iron core using an amorphous magnetic ribbon has an advantage that it has lower loss than an iron core in which electromagnetic steel sheets are laminated. However, among the wound iron cores using amorphous magnetic ribbons, especially large-sized wound iron cores are prone to buckling due to their own weights and easily deform. When the iron core deforms, there arises a problem that characteristics of the magnetic body are changed and the loss is increased. For this reason, support members are frequently used in this kind of stationary induction electric device to suppress the deformation of the iron core. For example, the following Patent Literature 1 describes that " . . . the iron core support member 100 is formed by integrating a side surface support member which supports a side surface of the amorphous iron core 110 and a corner portion support member 101 which supports a corner portion of the iron core; the corner portion support member 101 has a shape following the curve of the corner portion of the iron core, a plurality of the corner portion support members are arranged at a predetermined interval, and the amorphous iron core and the side surface support member are inserted into a coil" (see Abstract).

CITATION LIST

Patent Literature

PTL 1: JP-A-2013-243401

SUMMARY OF INVENTION

Technical Problem

In the structure disclosed in the Patent Literature 1, the deformation of the iron core can be suppressed to some extent. However, there is still room for further improvement. In addition, not only the weight of the iron core itself, but also the stress in a laminating direction of the iron core may become a factor of deforming the iron core and increasing the loss. However, in the Patent Literature 1, no particular consideration is given to the stress in the laminating direction of the iron core.

The present invention has been made in view of the above circumstances, and an object is to provide a stationary induction electric device which can reduce loss.

Solution to Problem

In order to solve the aforementioned problem, the stationary induction electric device of the invention comprises a first iron core block erected and formed in an annular shape, a second iron core block configured to surround the outer periphery of the first iron core block, a winding wound around the first and the second iron core blocks, a first support plate supporting the upper portion of the first iron core block from below, and a second support plate supporting the upper portion of the second iron core block from below, wherein a curvature radius of a curved portion appearing on the outer periphery of the lower portion of the second iron core block is larger than a curvature radius of a curved portion appearing on the outer periphery of the upper portion of the second iron core block.

Advantageous Effects of Invention

According to the stationary induction electric device of the invention, the loss can be suppressed.

BRIEF DESCRIPTION OF DRAWINGS

FIG. 1 is a front view of an iron core according to a comparative example.

FIG. 2 is a partially cutaway front view of a stationary induction electric device according to a first embodiment of the invention.

FIG. 3 is an enlarged view of a main portion of FIG. 2.

FIG. 4 is a front view of an iron core in the first embodiment.

FIG. 5 is a partially cutaway front view of a stationary induction electric device according to a second embodiment of the invention.

FIG. 6 is a partially cutaway front view of a stationary induction electric device according to a third embodiment of the invention.

DESCRIPTION OF EMBODIMENTS

Comparative Example

Before describing the embodiments of the invention, the configuration of an iron core according to a comparative example will be described. FIG. 1 is a front view of an iron core 2 according to the comparative example.

In FIG. 1, the iron core 2 has nested iron core blocks 2A, 2B and 2C. The iron core blocks 2A, 2B and 2C are respectively formed in a substantially rectangular frame shape with rounded corners. These iron core blocks 2A, 2B and 2C are laminated while curving an amorphous magnetic ribbon, and the direction from the inner side to the outer side is the laminating direction.

A support plate portion 3 supports the iron core 2 and includes support plates 3A, 3B and 3C which are in a substantially rectangular plate shape. These support plates 3A, 3B and 3C are disposed so as to adhere to the inner surfaces of upper portion yoke portions (upper side portions) of the iron core blocks 2A, 2B and 2C respectively, and are supported by support beams which are not shown in the drawing. Each of the iron core blocks 2A, 2B and 2C has a vertically symmetrical shape, and thus the curvature radiuses of the corner portions of these iron core blocks become larger in outer iron core blocks. The curvatures of both end portions of the support plates 3A, 3B and 3C also become larger in outer iron core blocks.

In the present comparative example, the iron core 2 is dispersed in a plurality of iron core blocks 2A, 2B and 2C. As a result, self-weight and stress in the laminating direction can be dispersed, and thus loss due to deformation of the iron core 2 can be reduced. However, in the comparative example, there is much dead space on the upper portion of the iron core 2. In this case, there is a problem that iron loss increases as the length of magnetic path increases, which offsets the loss reduction effect by suppressing the deformation of the iron core 2. In addition, there is also a problem that the size of a stationary induction electric device to which the iron core 2 is applied, and the size of a tank (not shown in the drawing) storing the same are increased. Therefore, the embodiments described below are intended to alleviate the aforementioned problems in the comparative example.

First Embodiment

Next, the configuration of a stationary induction electric device T1 according to a first embodiment of the invention will be described with reference to FIG. 2 to FIG. 4. Here, FIG. 2 is a partially cutaway front view of the stationary induction electric device T1, and FIG. 3 is an enlarged view of a main portion Q thereof. Further, FIG. 4 is a front view of an iron core 22.

In FIG. 2, the stationary induction electric device T1 is a transformer with a single phase tripod structure, and includes two iron cores 12 and 22 which are arranged adjacently, and a winding 11 wound around the iron cores 12 and 22. Here, the winding 11 includes a primary winding 11A wound in inner side and a secondary winding 11B wound in outer side. A lower portion fixing member 15 is fixed to the installation place of the stationary induction electric device T1.

Although only one support post 16 is shown in FIG. 2, the support post 16 is arranged at four corners of the lower portion fixing member 15 and altogether four support posts 16 are arranged. Each support post 16 is erected along the vertical direction, and the lower end portion thereof is fixed to the lower portion fixing member 15. An upper portion fixing member is fixed to the support post 16 while bridging the upper portions of the support posts 16 adjacent to each other in the left-right direction. Further, the upper portion fixing member 14 is also provided (not shown in the drawing) so as to bridge two support posts 16 on the rear surface of the stationary induction electric device T1. Support plate portions 13 and 23 support the iron cores 12 and 22 while being fixed to the upper portion fixing members 14 on the front surface and the rear surface. Fixation between the members may be realized by any method, such as bolt fastening, screw fastening, fastening with a tape or a string, and bonding with a resin.

The right side part of FIG. 2 shows a state in which a part of the winding 11, the upper portion fixing member 14, the lower portion fixing member 15, and the support post 16 are cut away. The iron core 22 includes nested iron core blocks 22A (first iron core block), 22B (second iron core block), and 22C (third iron core block). These iron core blocks 22A, 22B and 22C are wound iron cores in which amorphous magnetic ribbons are curved into annular shapes and are laminated, and the depth direction of the paper sheet is the width direction of the magnetic ribbon. Each of the iron core blocks 22A, 22B and 22C is formed in a substantially rectangular frame shape with rounded corners and has a bilaterally symmetrical shape. However, the curvature radius of the lower side corner is larger than the curvature radius of the upper side curved portion. The details will be described later. The iron core 12 includes iron core blocks 12A (first iron core block), 12B (second iron core block), and 12C (third iron core block), and is configured in the same manner as the iron core 22. In the iron cores 12 and 22, a portion extending along the vertical direction is referred to as an "iron leg". The primary winding 11A is wound so as to surround a right iron core leg of the iron core 12 and a left iron core leg of the iron core 22, and the secondary winding 11B is wound so as to further surround the primary winding 11A.

The upper portion fixing member 14 includes plate-shaped fixing members 14A, 14B and 14C, and these fixing members 14A, 14B and 14C are arranged in parallel along the horizontal direction and are fixed to the support posts 16 while bridging the left and right support posts 16 (the right side is not shown in the drawing). Further, as described above, the upper portion fixing member 14 which is not shown in the drawing is also provided on the rear surface of the stationary induction electric device T1, and the upper portion fixing member 14 on the rear surface also includes the fixing members 14A, 14B and 14C which are the same as those on the front surface.

The support plate portion 13 includes support plates 13A (first support plate), 13B (second support plate), and 13C (third support plate) which are in a substantially rectangular flat plate shape. These support plates 13A, 13B and 13C are arranged so as to bridge the fixing members 14A, 14B and 14C on the front surface and on the rear surface which are not shown in the drawing, and are fixed to these fixing members 14A, 14B and 14C. The support plates 13A, 13B and 13C support the iron core blocks 12A, 12B and 12C by adhering their upper surfaces to the inner surfaces of the upper portion yoke portions of the iron core blocks 12A, 12B and 12C. The support plate portion 23 includes support plates 23A, 23B and 23C configured in the same manner as the support plate portion 13.

The support plates 23A, 23B and 23C are arranged so as to bridge the fixing members 14A, 14B and 14C on the front surface and on the rear surface which are not shown, and support the iron core blocks 22A, 22B and 22C. That is, the support plates 13A and 23A are fixed to the upper surface of the fixing member 14A, the support plates 13B and 23B are fixed to the upper surface of the fixing member 14B, and the support plates 13C and 23C are fixed to the upper surface of the fixing member 14C. In addition, the winding 11 is fixed to the upper portion fixing member 14 and the lower portion fixing member 15.

Next, the main portion Q in FIG. 2 will be described in details. In FIG. 3, the iron core blocks 22A, 22B and 22C have a structure in which the horizontal upper portion yoke portion is curved at the end portion and extends to a vertical iron core leg, and the curvature radiuses of the curves in inner peripheries are respectively referred to as $R_{2A}$, $R_{2B}$ and $R_{2C}$. The iron core legs of the iron core blocks 22A, 22B and 22C are arranged with gaps $G_{AB}$ and $G_{BC}$. The support plates 23A, 23B and 23C are in a substantially flat plate shape with plate thicknesses of $T_{3A}$, $T_{3B}$ and $T_{3C}$ respectively, and are respectively in contact with the inner sides of the upper portion yoke portions of the iron core blocks 22A, 22B and 22C to support these upper portion yoke portions from below. The upper surface end portions of the support plates 23A, 23B and 23C are chamfered at curvature radiuses $R_{3A}$, $R_{3B}$ and $R_{3C}$ along the inner surfaces of the curved portions of the iron core blocks 22A, 22B and 22C respectively.

Here, the relationship among the above-mentioned dimensions will be described. First, the value of the curvature radius $R_{2A}$ of the iron core block 22A is preferably made as small as possible (for example, the minimum value) within an allowable range determined by the magnetic characteristics and the mechanical strength of the magnetic ribbon. Moreover, the gaps $G_{AB}$ and $G_{BC}$ are provided for reasons of workability and manufacturing tolerance, and are preferably to be set to about several mm. However, the iron core blocks 22A, 22B and 22C may be adhered to each other depending on conditions, and thus it is preferable to set within the ranges $0 \leq G_{AB} \leq 10$ mm and $0 \leq G_{BC} \leq$mm. Further, as to the relationship of the curvature radiuses of the support plates 23A, 23B, 23C and the iron core blocks 22A, 22B, 22C, it is preferable to set $R_{2A}=R_{3A}$, $R_{2B}=R_{3B}$, and $R_{2C}=R_{3C}$. In other words, the left and right ends of the support plates 23A, 23B and 23C are brought into contact with both ends of the upper portion yokes of the iron core blocks 22A, 22B and 22C which they support respectively, and are preferable to be chamfered with the innermost curvature radius.

In addition, regarding the relationship among the curvature radiuses $R_{2A}$, $R_{2B}$ and $R_{2C}$, it is preferable that $R_{2A} \leq R_{2B}$ and $R_{2A} \leq R_{2C}$. As to the relationship between the curvature radiuses $R_{2A}$, $R_{2B}$, $R_{2C}$ and the plate thicknesses $T_{3A}$, $T_{3B}$, $T_{3C}$, it is preferable that $R_{2A} \leq T_{3A}$, $R_{2B} \leq T_{3B}$, and $R_{2C} \leq T_{3C}$. The plate thicknesses $T_{3A}$, $T_{3B}$, and $T_{3C}$ are preferable to be sufficient to support the iron core blocks 22A, 22B and 22C respectively, and it is preferable to set the gaps that $G_{AB} \leq T_{3B}$, and $G_{BC} \leq T_{3C}$.

Next, the curvature radiuses of the curved portions on the outer periphery of the iron core blocks 22A, 22B and 22C will be described with reference to FIG. 4. A center line in the vertical direction of the iron core 2 is referred to as L, the upper side from the center line L is referred to as "upper portion", and the lower side from the center line L is referred to as "lower portion". The iron core block 22A includes a pair of vertical iron core legs 22AL and 22AR (first iron core legs), an upper portion yoke 22AU (first upper portion yoke) connecting the upper end portions of the iron core legs 22AL and 22AR, and a lower portion yoke 22AD (first lower portion yoke) connecting the lower end portions of the iron core legs 22AL and 22AR.

Similarly, the iron core blocks 22B includes a pair of vertical iron core legs 22BL and 22BR (second iron core legs), an upper portion yoke 22BU (second upper portion yoke) connecting the upper end portions of the iron core legs 22BL and 22BR, and a lower portion yoke 22BD (second lower portion yoke) connecting the lower end portions of the iron core legs 22BL and 22BR, and is configured to surround the upper, lower, left and right outer peripheries of the iron core block 22A. Further, the iron core block 22C includes a pair of vertical iron core legs 22CL and 22CR (third iron core legs), an upper portion yoke 22CU (third upper portion yoke) connecting the upper end portions of the iron core legs 22CL and 22CR, and a lower portion yoke 22CD (third lower portion yoke) connecting the lower end portions of the iron core legs 22CL and 22CR, and is configured to surround the upper, lower, left and right outer peripheries of the iron core block 22B.

The outer side curvature radiuses in the curved portions of the upper portion yoke portions of the iron core blocks 22A, 22B and 22C are referred to as $R_{2AU}$, $R_{2BU}$, and $R_{2CU}$, and the outer side curvature radiuses in the curved portions of the lower portion yoke portions of the iron core blocks 22A, 22B and 22C are referred to as $R_{2AL}$, $R_{2BL}$, and $R_{2CL}$. Here, it is preferable that the ratio of the upper and lower curvature radiuses "$R_{2BL}/R_{2BU}$" in the iron core block 22B is about 2 to 8, and the ratio of the upper and lower curvature radiuses "$R_{2CL}/R_{2CU}$" in the iron core block 22C is about 3 to 12. More preferably, the ratio "$R_{2BL}/R_{2BU}$" is about 2 to 4, and the ratio "$R_{2CL}/R_{2CU}$" is about 3 to 6.

Here, the significance of the range of each ratio described above will be explained. First, it is assumed that the ratio "$R_{2BL}/R_{2BU}$" is less than 2, or the ratio "$R_{2CL}/R_{2CU}$" is less than 3. When these ratios are to be realized by increasing the curvature radiuses $R_{2B}$ and $R_{2C}$ (see FIG. 3) of the inner side curved portions, the dead space on the upper portion of the iron core 22 increases. Further, when these ratios are to be realized by decreasing the curvature radiuses $R_{2BL}$ and $R_{2CL}$, it becomes necessary to push down the curved portions of the lower portion yoke portions of the iron core blocks 22B and 22C. In either case, there arises a problem that the volume of the iron core 22 increases and the loss increases.

Next, it is assumed that the ratio "$R_{2BL}/R_{2BU}$" is greater than 8, or the ratio "$R_{2CL}/R_{2CU}$" is greater than 12. When these ratios are to be realized by decreasing the curvature radiuses $R_{2B}$ and $R_{2C}$ (see FIG. 3) of the inner side curved portions, the distortion of the iron core blocks 22B and 22C becomes larger in the inner side curved portions, the iron core material cannot keep its original performance and the loss increases. Further, when these ratios are to be realized by increasing the curvature radiuses $R_{2BL}$ and $R_{2CL}$, the curved portions of the lower portion yoke portions of the iron core blocks 22B and 22C become larger, the volume of the iron core 22 increases and the loss increases. Therefore, as described above, it is preferable that the ratio "$R_{2BL}/R_{2BU}$" is about 2 to 8, and the ratio "$R_{2CL}/R_{2CU}$" is about 3 to 12. In addition, the dimensions of each portion of the iron core 12 and the support plate portion 13 are the same as those of the iron core 22 and the support plate portion 23.

As described above, according to the present embodiment, since the iron cores 12 and 22 are divided into a plurality of iron core blocks 12A, 12B, 12C, 22A, 22B and 22C and each iron core block is supported at the inner side of the upper portion yoke portion, it is possible to divide the weights of the iron cores 12 and 22 to support the same. As a result, distortions of the iron cores 12 and 22 and the stress in the laminating direction can be reduced, and the iron cores 12 and 22 with low losses can be realized. In addition, with regard to the iron core blocks 22B and 22C, the curvature radiuses $R_{2BL}$ and $R_{2CL}$ of the curved portions appearing on the outer periphery of the lower portion are made twice or more, or three times or more the curvature radiuses $R_{2BU}$ and $R_{2CU}$ of the curved portions appearing on the outer periphery of the upper portion. In this way, the volumes and weights of the iron cores 12 and 22 can be reduced.

Further, since the curvature radiuses $R_{2B}$ and $R_{2C}$ of the inner side curved portions of the iron core blocks 12B, 12C, 22B and 22C are made equal to or less than the plate thicknesses $T_{3B}$ and $T_{3C}$ of the support plates 13B, 13C, 23B and 23C, the support plates 13B, 13C, 23B and 23C can be formed in a flat plate shape. In this way, the upper portion yoke portions of the iron core blocks 12A, 12B, 12C, 22A, 22B and 22C can be arranged close to each other, the amount of the magnetic ribbon constituting the iron cores 12 and 22 can be reduced, and the weights and volumes of the stationary induction electric device T1 and the tank storing the same can be reduced.

Second Embodiment

Next, a stationary induction electric device T2 according to a second embodiment of the invention will be described.

FIG. 5 is a partially cutaway front view of the stationary induction electric device T2. In FIG. 5, parts corresponding to those in FIGS. 1 to 4 are given the same reference signs and numerals, and the description thereof may be omitted in some cases.

In FIG. 5, the stationary induction electric device T2 is a transformer with a single phase tripod structure, and includes iron cores 12 and 22, a winding 11, support plate portions 33 and 43, an upper portion fixing member 14, a lower portion fixing member 15, a plurality of support posts 16, and support beam portions 17 and 27.

Here, the configurations of the iron cores 12 and 22, the winding 11, the upper portion fixing member 14, the lower portion fixing member 15, and the support posts 16 are the same as those of the first embodiment (see FIG. 2). Like the support plate portions 13 and 23 of the first embodiment, the support plate portions 33 and 43 are formed in a flat plate shape, and include support plates 33A (first support plate), 33B (second support plate), 33C (third support plate), 43A (first support plate), 43B (second support plate), and 43C (third support plate) supporting the iron core blocks 12A, 12B, 12C, 22A, 22B and 22C respectively. However, the lengths of the support plate portions 33 and 43 in the front-rear direction (the direction perpendicular to the paper sheet) are in the range in which they come into contact with the iron cores 12 and 22, and are slightly shorter than the support plate portions 13 and 23 of the first embodiment.

The support beam portions 17 and 27 include support beams 17A, 17B, 17C, 27A, 27B and 27C, the cross-sectional shapes of which are substantially rectangular. These support beams are fixed so as to bridge the upper surfaces of the fixing members 14A, 14B and 14C on the front surface and on the rear surface which are not shown in the drawing. The support plates 33A, 33B, 33C, 43A, 43B and 43C are fixed so as to bridge the upper surfaces of the support beams 17A, 17B, 17C, 27A, 27B and 27C, and support the corresponding iron core blocks 12A, 12B, 12C, 22A, 22B and 22C.

According to the present embodiment, similar to the first embodiment, the iron cores 12 and 22 with low losses can be realized, the amount of the magnetic ribbon constituting the iron cores 12 and 22 can be reduced, and the weights and volumes of the stationary induction electric device T2 and the tank storing the same can be reduced. Moreover, according to the embodiment, instead of the support plate portions 13 and 23 (see FIG. 2) of the first embodiment, the support beam portions 17 and 27, and the support plate portions 33 and 43 supporting the same from below are applied, and the widths of the support beam portions 17 and 27 in the left-right direction is made smaller than those of the support plate portions 33 and 32. As a result, the support plate portions 33 and 43 can be made thinner than the support plate portions 13 and 23 of the first embodiment, and the weight of the whole can be reduced. This is because the support beam portions 17 and 27 can realize a structure having a higher section modulus with a smaller sectional area comparing with the support plate portions 33 and 34.

Third Embodiment

Next, a stationary induction electric device T3 according to a third embodiment will be described.

FIG. 6 is a partially cutaway front view of the stationary induction electric device T3. In FIG. 6, parts corresponding to those in FIGS. 1 to 5 are given the same reference signs and numerals, and the description thereof may be omitted in some cases.

In FIG. 6, the stationary induction electric device T3 is a transformer with a single phase tripod structure, and includes iron cores 12 and 22, a winding 11, support plate portions 33 and 32, an upper portion fixing member 14, a lower portion fixing member 15, a plurality of support posts 16, and support beam portions 18 and 28.

Here, the configurations of the iron cores 12 and 22, the winding 11, the upper portion fixing member 14, the lower portion fixing member 15, the support posts 16 are the same as those of the first embodiment (see FIG. 2). In addition, among the support plate portions 33 and 43, the configurations of the support plates 33B, 33C, 43B and 43C other than those on the innermost periphery are the same as those of the second embodiment (see FIG. 5). The support plates 33A and 43A positioned on the innermost periphery are formed in the same manner as the support plates 13A and 23A in the first embodiment (see FIG. 2). That is, the support plates 33A and 43A are arranged so as to bridge the fixing members 14A on the front surface and on the rear surface which are not shown in the drawing, are fixed by these fixing members 14A, and support the iron core blocks 12A and 22A.

The support beam portions 18 and 28 include support beams 18B, 18C, 28B and 28C. These support beams are arranged along the left and right ends of the support plates 33B, 33C, 43B and 43C so as to bridge the fixing members 14B and 14C on the front surface and on the rear surface which are not shown in the drawing, and are fixed to these fixing members 14B and 14C. Here, the support beams 18B, 18C, 28B and 28C are formed with their cross-sections in a substantially right-angled isosceles triangular shape, and are arranged such that the width in the left-right direction becomes smaller as going downwards.

A gap in a substantially right-angled isosceles triangular shape is generated between the curved portions on the outer sides of the iron core blocks 12A and 22A and the curved portions on the inner sides of the iron core blocks 12B and 22B. Similarly, a gap in a substantially right-angled isosceles triangular shape is generated between the curved portions on the outer sides of the iron core blocks 12B and 22B and the curved portions on the inner sides of the iron core blocks 12C and 22C. In the present embodiment, the support beam portions 18 and 28 are inserted through these gaps, and thus the space generated between the iron core blocks can be effectively used.

As described above, according to the embodiment, similar to the first and second embodiments, the iron cores 12 and 22 with low losses can be realized, the amount of the magnetic ribbon constituting the iron cores 12 and 22 can be reduced, and the weights and volumes of the stationary induction electric device T3 and the tank storing the same can be reduced. Moreover, according to the embodiment, the space generated between the iron core blocks can be effectively used, and as a result, the amount of the magnetic ribbon constituting the iron cores 12 and 22 can be further reduced.

[Variations]

The invention is not limited to the aforementioned embodiments, and all kinds of variations are possible. The aforementioned embodiments are exemplified for a better understanding of the invention, and are not necessarily limited to those having all of the described configurations. Moreover, a part of the configuration of one embodiment may be replaced with the configuration of another embodiment, and the configuration of one embodiment may be added with the configuration of another embodiment. In addition, a part of the configuration of each embodiment may be deleted, or added and/or replaced with another configuration. Possible variations to the aforementioned embodiments are, for example, as follows.

(1) The iron cores 12 and 22 in each of the above-described embodiments are wound iron cores in which the amorphous magnetic ribbons are laminated. However, applicable iron cores are not limited thereto, and the invention may also be applied to iron cores in which electromagnetic steel sheets are laminated and other iron cores.

(2) In each of the above-described embodiments, the stationary induction electric devices T1 to T3 are single phase tripod transformers. However, the invention may also be applied to various kinds of stationary induction electric devices such as three-phase five-leg transformers, three-phase tripod transformers, and reactors.

(3) In the support plate portions 13, 23, 33 and 34 in each of the above-described embodiments, flat plate-shaped support plates (13A, etc.) are applied. However, the shape of the support plate is not limited to the flat plate shape, and may be, for example, an arcuate shape slightly protruding upwards. In this case, the shapes of the lower surfaces of the upper portion yoke portions of the iron core blocks 12A, 12B, 12C, 22A, 22B and 22C may also be curved into an arcuate shape along the corresponding support plates.

(4) The support beams 17A, 17B, 17C, 27A, 27B and 27C in the second embodiment have substantially rectangular cross-sectional shapes. However, as these support beams, L steel, H steel, and I steel may be applied, and a combination of a flat plate and a stay may also be applied.

(5) The cross-sectional shapes of the support beams 18B, 18C, 28B and 28C in the third embodiment are substantially right-angled isosceles triangular. However, those with other cross-sectional shapes may also be applied. That is, as long as they have a cross-sectional shape in which the width becomes smaller as going downwards, similar to the third embodiment, an effect of effectively using the space can be achieved.

REFERENCE SIGNS LIST

2: iron core
2A, 2B, 2C: iron core block
3: support plate portion
3A, 3B, 3C: support plate
11: winding
11A: primary winding
11B: secondary winding
12, 22: iron core
12A, 22A: iron core block (first iron core block)
12B, 22B: iron core block (second iron core block)
12C, 22C: iron core block (third iron core block)
13, 23: support plate portion
13A, 23A: support plate (first support plate)
13B, 23B: support plate (second support plate)
13C, 23C: support plate (third support plate)
14: upper portion fixing member
14A, 14B, 14C: fixing member
15: lower portion fixing member
16: support post
17, 27: support beam portion
17A, 17B, 17C, 27A, 27B, 27C: support beam
18, 28: support beam portion
18B, 18C, 28B, 28C: support beam
22AD: lower portion yoke (first lower portion yoke)
22AU: upper portion yoke (first upper portion yoke)
22BD: lower portion yoke (second lower portion yoke)
22BU: upper portion yoke (second upper portion yoke)
22CD: lower portion yoke (third lower portion yoke)
22CU: upper portion yoke (third upper portion yoke)
22AL, 22AR: iron core leg (first iron core leg)
22BL, 22BR: iron core leg (second iron core leg)
22CL, 22CR: iron core leg (third iron core leg)
33, 34: support plate portion
33A, 43A: support plate (first support plate)
33B, 43B: support plate (second support plate)
33C, 43C: support plate (third support plate)
T1 to T3: stationary induction electric device

The invention claimed is:

1. A stationary induction electric device, comprising
a first iron core block erected and formed in an annular shape,
a second iron core block configured to surround the outer periphery of the first iron core block,
a winding wound around the first and the second iron core blocks,
a first support plate supporting the upper portion of the first iron core block from below, and
a second support plate supporting the upper portion of the second iron core block from below,
wherein a curvature radius of a curved portion appearing on the outer periphery of the lower portion of the second iron core block is larger than a curvature radius of a curved portion appearing on the outer periphery of the upper portion of the second iron core block.

2. The stationary induction electric device according to claim 1, wherein
the first support plate and the second support plate are formed in a substantially flat plate shape.

3. The stationary induction electric device according to claim 1, wherein
the first iron core block includes a pair of vertical first iron core legs, a first upper portion yoke connecting the upper end portions of the first iron core legs, and a first lower portion yoke connecting the lower end portions of the first iron core legs,
the second iron core block includes a pair of vertical second iron core legs, a second upper portion yoke connecting the upper end portions of the second iron core legs, and a second lower portion yoke connecting the lower end portions of the second iron core legs,
the first iron core legs and the second iron core legs are separated by a predetermined gap, and the thickness of the second support plate is larger than the gap.

4. The stationary induction electric device according to claim 1, further comprising
a support beam supporting the second support plate from below, the width of the support beam being smaller than that of the second support plate.

5. The stationary induction electric device according to claim 4, wherein
the cross-section of the support beam is in a substantially rectangular shape.

6. The stationary induction electric device according to claim 4, wherein
the support beam has a cross-sectional shape in which the width decreases as going downwards.

7. The stationary induction electric device according to claim 6, wherein
the support beam is disposed at both ends of the second support plate.

8. The stationary induction electric device according to claim 3, further comprising
a third iron core block including a pair of vertical third iron core legs, a third upper portion yoke connecting the upper end portions of the third iron core legs, and a third lower portion yoke connecting the lower end portions of the third iron core legs, the third iron core block being configured to surround the outer periphery of the second iron core block, and
a third support plate supporting the upper portion of the third iron core block from below, wherein a curvature radius of a curved portion appearing on the outer periphery of the lower portion of the second iron core block is twice or more a curvature radius of a curved portion appearing on the outer periphery of the upper portion of the second iron core block, and a curvature radius of a curved portion appearing on the outer periphery of the lower portion of the third iron core block is three times or more a curvature radius of a curved portion appearing on the outer periphery of the upper portion of the third iron core block.

* * * * *